US006767007B2

(12) United States Patent
Luman

(10) Patent No.: US 6,767,007 B2
(45) Date of Patent: Jul. 27, 2004

(54) DIRECT INJECTION CONTACT APPARATUS FOR SEVERE SERVICES

(76) Inventor: Homer C. Luman, 80 Idlewild St., Lumberton, TX (US) 77657

( * ) Notice: Subject to any disclaimer, the term of this patent is extended or adjusted under 35 U.S.C. 154(b) by 71 days.

(21) Appl. No.: 10/108,103

(22) Filed: Mar. 25, 2002

(65) Prior Publication Data

US 2003/0178732 A1 Sep. 25, 2003

(51) Int. Cl.[7] ..... B01F 3/04

(52) U.S. Cl. ..... 261/76; 261/79.2; 366/165.2; 366/178.3

(58) Field of Search ..... 261/76, 79.2; 366/107, 366/165.1, 165.2, 178.3

(56) References Cited

U.S. PATENT DOCUMENTS

| | | | | |
|---|---|---|---|---|
| 145,538 | A | | 12/1873 | Stoddart |
| 427,193 | A | | 5/1890 | Schutte |
| 613,093 | A | | 10/1898 | Tyson |
| 847,010 | A | | 3/1907 | Koerting |
| 1,140,548 | A | | 5/1915 | Vogelsang |
| 1,315,931 | A | | 9/1919 | Poppink |
| 1,427,202 | A | | 8/1922 | Furness et al. |
| 1,677,265 | A | | 7/1928 | Boving |
| 1,846,220 | A | | 2/1932 | McCune, Jr. |
| 1,848,122 | A | | 3/1932 | Forster |
| 2,089,132 | A | | 8/1937 | Murray |
| 2,094,664 | A | | 10/1937 | Monahan |
| 2,115,470 | A | | 4/1938 | Rogers |
| 2,452,260 | A | | 10/1948 | Peebles |
| 2,455,498 | A | | 12/1948 | Kern |
| 2,483,426 | A | | 10/1949 | Moore |
| 2,820,620 | A | | 1/1958 | Anderson |
| 3,331,590 | A | | 7/1967 | Battenfeld et al. |
| 3,409,274 | A | | 11/1968 | Lawton |
| 3,984,504 | A | | 10/1976 | Pick |
| 4,046,189 | A | | 9/1977 | Clark, Jr. |
| 4,053,142 | A | * | 10/1977 | Johannes |
| 4,123,800 | A | | 10/1978 | Mazzei |
| 4,173,178 | A | | 11/1979 | Wieland |
| 4,211,277 | A | | 7/1980 | Grosz-Roll, Friedrich et al. |
| 4,473,512 | A | | 9/1984 | Pick et al. |
| 4,474,477 | A | | 10/1984 | Smith et al. |
| 4,498,786 | A | | 2/1985 | Ruscheweyh |
| 4,505,865 | A | | 3/1985 | Wullenkord |
| 4,625,916 | A | | 12/1986 | Nieuwkamp et al. |
| 4,656,001 | A | | 4/1987 | Roger et al. |
| 4,689,237 | A | | 8/1987 | Fabre |
| 4,732,712 | A | | 3/1988 | Burnham et al. |
| 4,743,405 | A | | 5/1988 | Durao et al. |
| 4,761,077 | A | | 8/1988 | Werner |
| 4,874,560 | A | | 10/1989 | Titmas |
| 4,919,541 | A | | 4/1990 | Grosz-Roell et al. |
| 4,931,225 | A | | 6/1990 | Cheng |
| 5,004,484 | A | | 4/1991 | Stirling et al. |
| 5,131,757 | A | | 7/1992 | Smith |
| 5,194,187 | A | | 3/1993 | Fagin |
| 5,240,650 | A | | 8/1993 | Wiederhold et al. |
| 5,291,943 | A | | 3/1994 | Dhir |
| 5,338,113 | A | * | 8/1994 | Fissenko |
| 5,395,569 | A | | 3/1995 | Badertscher et al. |
| 5,492,404 | A | * | 2/1996 | Smith |
| 5,496,505 | A | | 3/1996 | Walla et al. |
| 5,575,232 | A | | 11/1996 | Kato et al. |
| 5,622,655 | A | | 4/1997 | Cincotta et al. |
| 5,743,638 | A | | 4/1998 | Cummins et al. |

(List continued on next page.)

FOREIGN PATENT DOCUMENTS

| | | |
|---|---|---|
| GB | 694918 | 7/1953 |

*Primary Examiner*—Scott Bushey
(74) *Attorney, Agent, or Firm*—Paula D. Morris & Assoc., PC

(57) ABSTRACT

A direct injection contacting apparatus for contacting a first fluid with a second fluid which facilitates heat and mass transfer operations.

42 Claims, 4 Drawing Sheets

U.S. PATENT DOCUMENTS

| | | | |
|---|---|---|---|
| 5,820,259 | A | 10/1998 | Cummins et al. |
| 5,935,490 | A | 8/1999 | Archbold et al. |
| 5,980,613 | A | 11/1999 | Reiber |
| 6,017,569 | A | 1/2000 | Badertscher |
| 6,019,895 | A | 2/2000 | Dupre |
| 6,082,712 | A | 7/2000 | Cincotta et al. |
| 6,082,713 | A | 7/2000 | King |
| 6,186,481 | B1 | 2/2001 | Pirkle |
| 6,238,912 | B1 | 5/2001 | Moore et al. |
| 6,290,917 | B1 | 9/2001 | Yamamoto |

* cited by examiner

DIRECT INJECTION CONTACT APPARATUS FOR SEVERE SERVICES

FIELD OF THE INVENTION

A contact apparatus for heat and mass transfer operations that require extended service life considerations and/or frequent cleaning to maintain operability.

BACKGROUND OF THE INVENTION

Various devices exist to facilitate simultaneous heat and mass transfer operations between two or more fluids, the most common application being the heating of clean water using dry steam while providing for quiet operation. Most of these devices are unsuitable for applications in the chemical and refining industries, which often involve viscous liquids, high solids loadings, erosive materials, or wet/dirty vapor streams.

In such "severe applications," clogging of tight internal passages often is quick and complete. Failure of internal components related to impingement damage or erosion is not uncommon. In "severe applications," downtime for maintenance is not normally available without great cost due to lost production potential and the inherent safety/environmental risks associated with startups or shutdowns. A need exists for a direct injection contacting apparatus of durable construction that will function reliably in severe applications and will continuously operate over an extended lifetime with minimal maintenance.

SUMMARY OF THE INVENTION

An apparatus for directly contacting a first fluid with a second fluid, said apparatus comprising; a sealed chamber assembly comprising a chamber wall defining a chamber bore having a chamber bore diameter and a chamber longitudinal axis, said chamber wall comprising an injection port, said injection port being in fluid communication with said second fluid; a combining tube comprising a combining tube wall defining a combining tube bore having a combining tube bore diameter that is less than said chamber bore diameter and having a combining tube longitudinal axis which is substantially the same as said chamber longitudinal axis, said combining tube bore comprising an upstream port and a downstream port in fluid communication with said first fluid, said chamber wall and said combining tube wall defining an annular space therebetween; said combining tube wall comprising an upstream set of perforations adjacent to said upstream port, a downstream set of perforations adjacent to said downstream port, and an unperforated section between said upstream set of perforations and said downstream set of perforations, said unperforated section being adjacent to said injection port; said injection port being adapted to prevent said second fluid from directly impinging said combining tube wall; said sealed chamber assembly and said perforations being adapted to produce a turbulent flow of said first fluid and said second fluid within said combining tube bore upon injection of said second fluid through said injection port, said turbulent flow being consistent with non-fouling operation of said apparatus.

DETAILED DESCRIPTION

Figure 1:
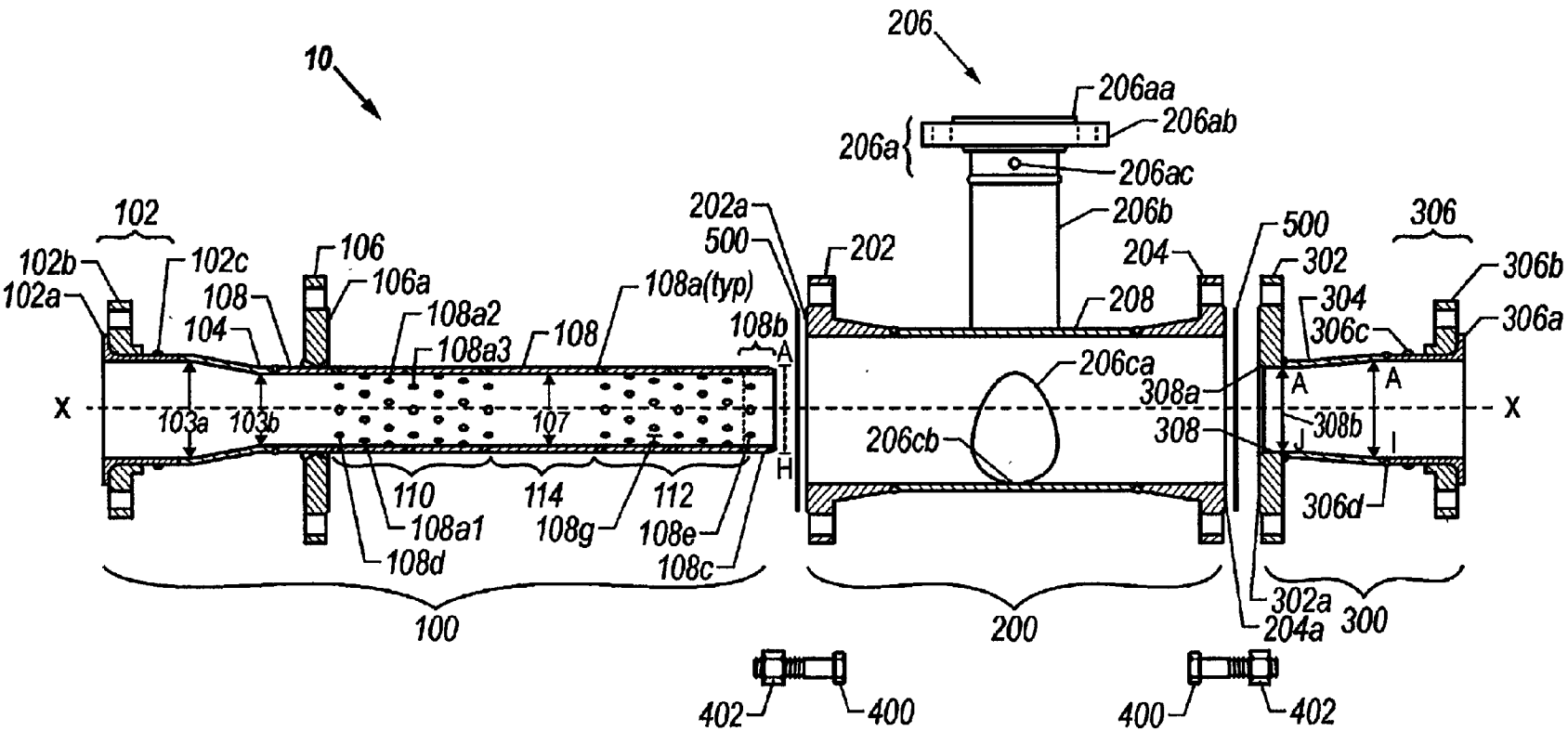
FIG. 1 illustrates an exploded side view of the components of an embodiment of the present invention.

The present application provides a direct injection contact apparatus 10 that avoids or reduces the shortcomings noted above. In a preferred embodiment, the contact apparatus 10 of the present invention comprises a three part slip fit sealed chamber assembly providing for the direct contact between a first fluid 120 and a second fluid 220 (FIG. 2). The first fluid 120 flows longitudinally through a conduit within the chamber assembly wherein said first fluid 120 is contacted by said second fluid 220 through the perforations 108*a* (FIG. 1) along the conduit wall. The perforations 108*a* are distributed along the conduit wall in a manner to reduce fouling and to facilitate a concurrent turbulent flow. The contact apparatus 10 will be described in more detail with reference to the embodiment illustrated in the drawings. The drawings are illustrative only, and are not to be construed as limiting the invention, which is defined in the claims.

Figure 2:
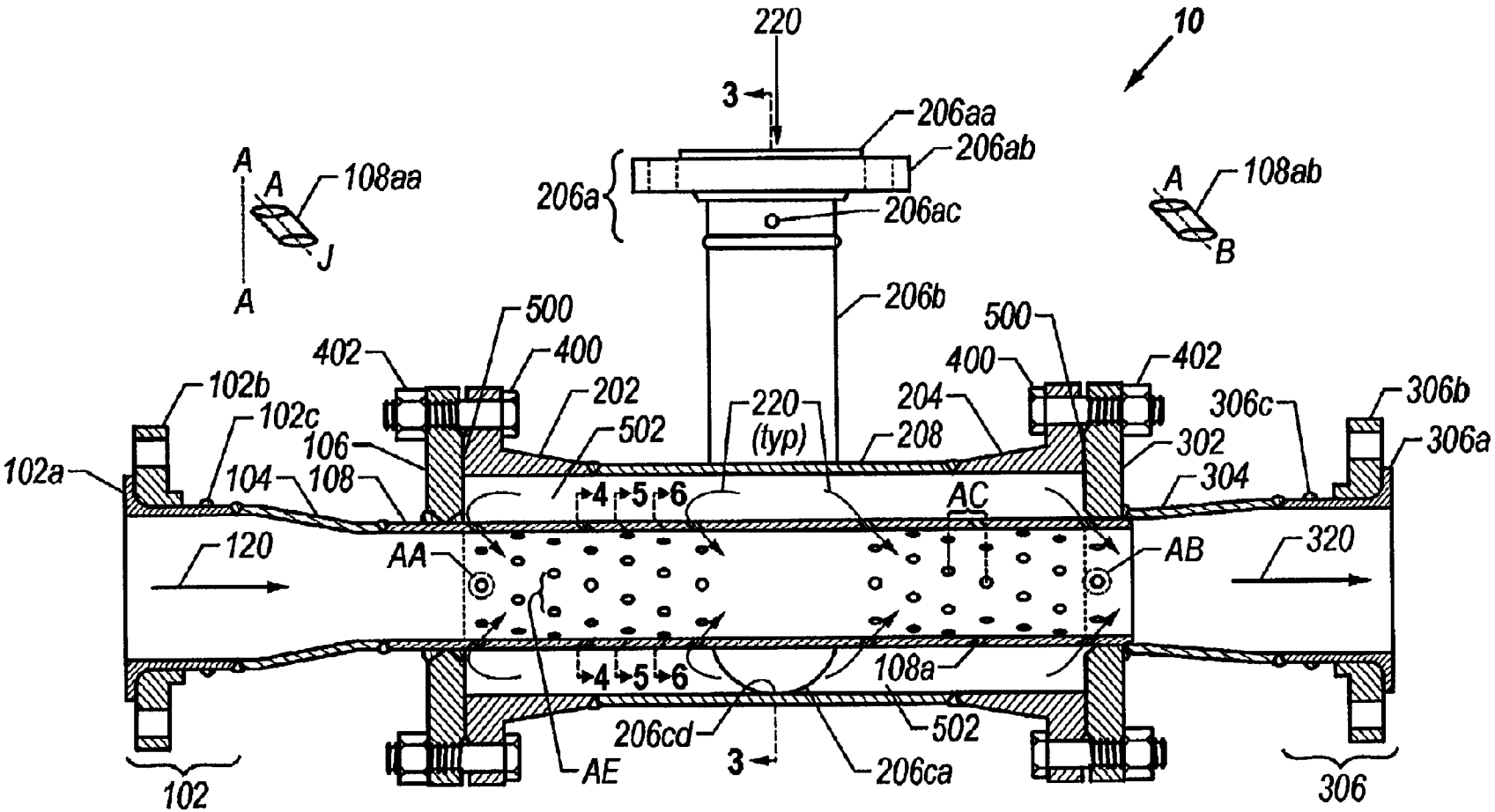
FIG. 2 illustrates a side elevational view showing a longitudinal cross section of an embodiment of the present invention taken along section line 2 in FIG. 3.

Referring to FIG. 1, contact apparatus 10 is comprised of stinger assembly 100, chamber assembly 200, outlet assembly 300, two chamber gaskets 500, closure bolts 400, and an equal number of closure nuts 402. Stinger assembly 100 forms a liquid conduit extending from the point of entry 102 of first fluid 120, through chamber assembly 200, and into outlet assembly 300. In a preferred embodiment, stinger assembly 100 is comprised of first inlet connection 102, inlet transition 104, combining tube 108, and stinger end closure flange 106.

Fluid preferably enters stinger assembly 100 through first inlet connection 102. First inlet connection 102 is a standard piping connection chosen to facilitate installation of the assembled contact apparatus 10 into the process piping arrangement. In a preferred embodiment, a first inlet stub end 102*a*, first inlet lap joint flange 102*b*, and first inlet flange retainers 102*c* comprise first inlet connection 102 as shown in FIG. 1 and FIG. 2. In the illustrated embodiment, first inlet flange retainers 106*c* are small weld beads on the outer surface of stub end 102*a* which restrict lateral movement of first inlet lap joint flange 102*b* along stinger assembly 100. A rotationally oriented connection such as a raised face weld neck flange or another non-rotationally oriented connection such as a sanitary fitting may be used for first inlet connection 102 in other embodiments of the invention. Non-rotationally oriented connections, such as the lap joint-stub end combination of the illustrated preferred embodiment reduce fabrication, assembly, installation, and maintenance manhour requirements.

In a preferred embodiment, inlet transition 104 is a tubular component of circular cross section connected at one end to first inlet connection 102 at first inlet stub end 102*a*, and at an opposed end to combining tube 108 in such a way as to maintain a common longitudinal axis X—X for all components of stinger assembly 100. The internal diameter of inlet transition 104 is nominally the same as that of first inlet connection 102 at the point of connection 103*a* to said first inlet connection 102, gradually transitioning to the same nominal internal diameter 103*b* as combining tube 108 at the point of connection to said combining tube 108. One skilled in the art may readily recognize that inlet transition 104 may be unnecessary in other embodiments of the present invention.

In a preferred embodiment, combining tube 108 is a tubular component of circular cross section fabricated from seamless pipe having a wall thickness corresponding to schedule 80 or one weight class higher than that used for the first fluid 120 process inlet piping, whichever is greater. The heavy construction of combining tube 108 contributes to enhanced life and reduced noise transmission. The nominal diameter 107 of the pipe used to fabricate combining tube 108 in a preferred embodiment is chosen to maintain a liquid flow velocity based on inlet conditions to combining tube 108 of from about 1.2 m/sec to about 3.6 m/sec. This velocity range minimizes solids deposition and erosion damage in combining tube 108.

Combining tube 108 extends from its junction with inlet transition 104 through stinger end closure flange 106, which is designed to mate with either first chamber closure flange 202 or second chamber closure flange 204 at stinger end closure flange sealing face 106*a*. Upon mating at either first chamber closure flange 202 or second chamber closure flange 204, combining tube 108 is positioned within mating hole 308 of outlet assembly 300 comprising a running fit between stinger discharge end 108*b* and mating hole 308. In a preferred embodiment stinger end closure flange 106 consists of a raised face blind flange which has been axially bored to accommodate passage of combining tube 108 in a manner such that stinger end closure flange sealing face 106*a* faces away from first inlet connection 102 and is perpendicular in all respects to the longitudinal axis X—X for all other components of stinger section 100. Stinger end closure flange 106 is attached to combining tube 108 by a complete fusion weld with full joint penetration in a manner such that a common longitudinal axis X—X is maintained between stinger end closure flange 106 and combining tube 108. In a preferred embodiment, lateral placement of stinger end closure flange 106 is at a point 25 to 30 mm downstream of the weld between combining tube 108 and inlet transition 104 in order to minimize overlap of the heat affected zones resulting from the two welding procedures.

Stinger discharge end 108*b* is machined to slip through a mating hole 308 in outlet end closure flange 302 comprising a loose running fit along common longitudinal axis X—X. The slip fit clearance 504 relieves mechanical stresses induced by temperature differentials-between fluid streams. The slip fit clearance 504 also allows for absorption of a substantial amount of the shock force generated by rapid vapor bubble collapse by the combining tube 108 with very limited sound transmission.

Figure 7:
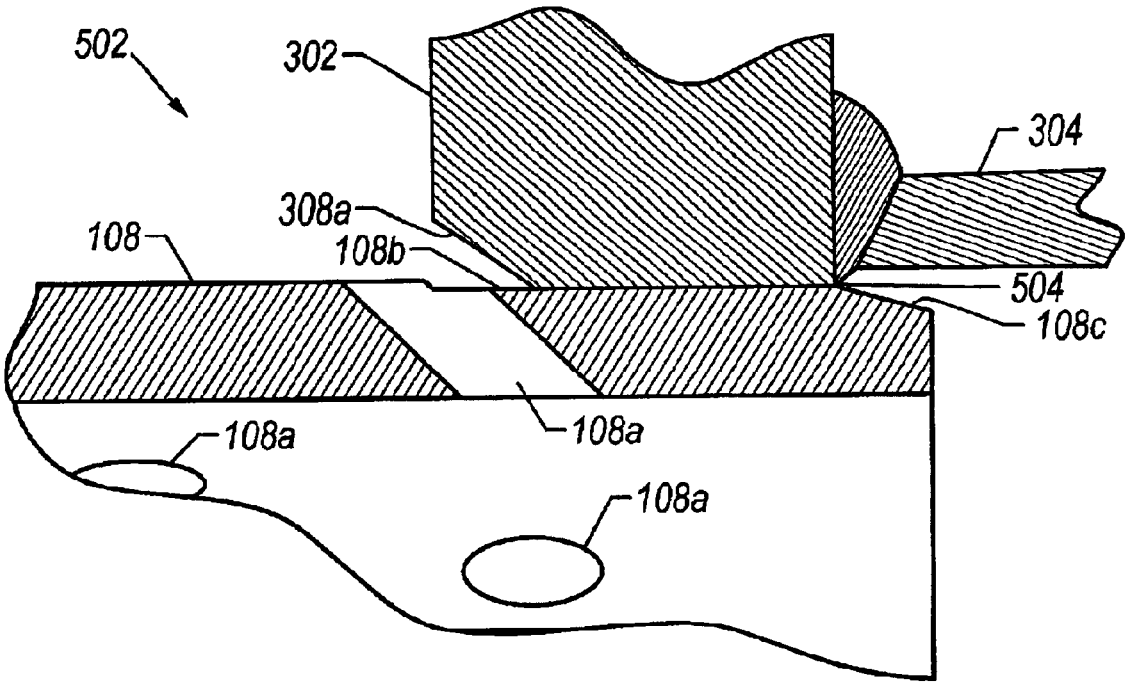
FIG. 7 illustrates a side elevational view showing the relationship between the stinger discharge end 108*b* and the outlet end closure flange 302.

As shown in FIG. 2 and FIG. 7, the machined area of combining tube 108 comprising stinger discharge end 108*b* preferably begins at the plane defined by the sealing face 302*a* (FIG. 1) of outlet end closure flange 302 and continues to tip bevel 108*c*. In a preferred embodiment, said machined area protrudes 5 mm to 10 mm beyond the downstream end 308*b* (FIG. 1) of mating hole 308. The protrusion of tip bevel 108*c*, beyond 308*b*, results in easier unit disassembly when handling fouling liquids such as latex.

In a preferred embodiment illustrated by FIG. 7, tip bevel 108*c* begins at a point 5 mm to 10 mm from the downstream end of combining tube 108, proceeding inward to constitute a bevel at an angle of about 10° to about 30° relative to the longitudinal axis X—X of stinger section 100. Bore bevel 308*a* (FIG. 1 and FIG. 7) on the upstream side of outlet end closure flange 302 begins preferably 5 mm to 10 mm inside mating hole 308 proceeding upstream to outlet end closure flange sealing face 302*a* at an angle of about 30° to about 45° to longitudinal axis X—X of mating hole 308. The use of tip bevel 108*c* and bore bevel 308*a* simplifies assembly of contact apparatus 10 by guiding stinger section 100 and outlet section 300 into proper alignment along a common longitudinal axis. In a preferred embodiment, slip fit clearance 504 comprises a running fit with a diameter differential between stinger discharge end 108*b* and mating hole 308 of 0.05 mm to 0.1 mm clearance.

As shown in FIG. 1 and FIG. 2, the sections 110, 112 of combining tube 108 exposed to annular space 502 (FIG. 2) contain a number of combining tube perforations 108*a* which form passages for second fluid 220 to flow from annular space 502 into combining tube 108, where it mixes intimately with first fluid 120. Perforations 108*a* are grouped into upstream section 110 and downstream section 112, which are separated by unperforated section 114.

Figure 3:
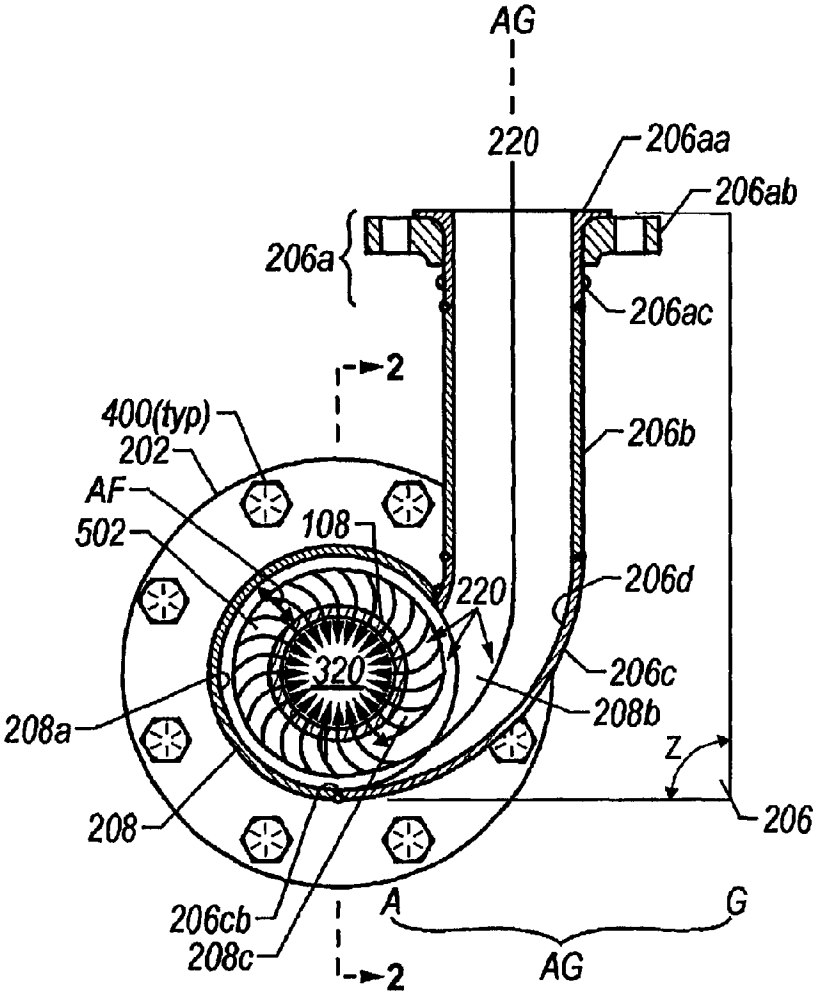
FIG. 3 illustrates a end elevational view taken along section line 3 shown in FIG. 2.

Referring to FIG. 3, unperforated section 114 promotes establishment of a rotational flow path for second fluid 120 as it enters annular space 502, minimizing erosive damage to combining tube 108 and resulting in substantially even pressure distribution preferably along the full length of combining tube 108, without obstructing the direct flow path of second fluid 120. Unperforated section 114 is positioned along combining tube 108 such that it is centered between plane A—A defined by stinger end closure flange sealing face 106*a* and plane A–B defined by outlet end closure flange sealing face 302*a* in the assembled contacting apparatus 10. Unperforated section 114 extends upstream and downstream from this central point beyond the lateral extents of injection port 206*ca* in the assembled contacting apparatus 10 preferably a distance of 1 cm to 2 cm to promote establishment of the rotational path around the annular space 502.

Combining tube perforations 108*a* preferably are divided essentially equally between upstream section 110 and downstream section 112. Pattern layout, size, and number of said perforations 108*a* within upstream section 110 and downstream section 112 may be determined by one skilled in the art using well established engineering principles applied to the process data at hand to produce a desired process result. In a preferred embodiment, perforations 108*a* comprise bores having a longitudinal axis and an internal diameter from about 5 mm to about 10 mm, said diameter producing optimal interfacial areas between first fluid 120 and second fluid 220 inside combining tube 108 consistent with non-fouling operation of stinger assembly 100. The number of perforations 108*a* will vary to accommodate the required flow of second fluid 120 while minimizing direct contact between the first fluid 120 and the second fluid 220. The length 100 of combining tube 108 and correspondingly, the length 200 of chamber body 208 will vary to accommodate the number of combining tube perforations 108*a*.

Combining tube perforations 108*a* are arranged within upstream section 110 and downstream section 112 in configurations which yield desired process results. In a preferred embodiment illustrated in FIGS. 1 through 7, perforations 108*a* are arranged in circumferential rows having a symmetrical radial pattern of perforations 108*a*. The most upstream row 108*d* (FIG. 1) of perforations 108*a* in said upstream section 110 is positioned such that the most upstream edge 108*aa* (FIG. 2) of perforations 108*a* in this row physically contact the plane A—A defined by stinger end closure flange sealing face 106*a*. The most downstream row 108*e* (FIG. 1) of perforations 108*a* in downstream section 112 is positioned such that a portion, preferably about half of the inner diameter 108*ab* (FIG. 2) of perforations 108*a* in row 108*e* lies downstream of plane A–B defined by outlet end closure flange sealing face 302*a* when contact apparatus 10 is properly assembled. The remaining rows of combining tube perforations 108*a* are preferably distributed equally between upstream section 110 and downstream section 112, spaced substantially evenly along the lengths of said two sections. In a preferred embodiment, the minimum distance A–C (FIG. 2) between lines drawn along the longitudinal axis AB of the perforations is at least three times the diameter of the perforations 108*a*.

Figure 4:
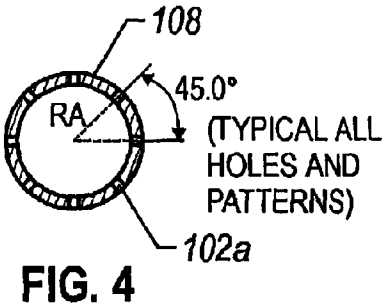
FIGS. 4, 5 and 6 illustrate axial cross sections of the combining tube 108 taken along the section lines shown in FIG. 2.
Figure 5:
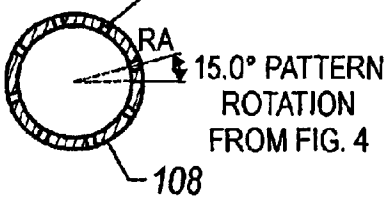
Figure 6:
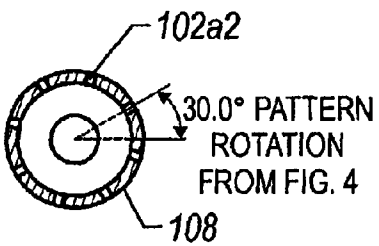

In a preferred embodiment, combining tube perforations 108*a* in a given row 108*d*, 108*a*1, 108*a*2, 108*a*3, etc., (FIG. 1) are arranged symmetrically around the circumference of the combining tube 108 with a minimum radial angle RA (FIG. 5) between their longitudinal axes (AJ, AB, FIG. 2) of 45° (FIG. 4). Succeeding rows of perforations 108*a* are rotationally offset a minimum of about 15° from the previous row, and are arranged to form a repeating pattern of perforations 108*a* every three to six rows. In a preferred embodiment, perforations 108*a* in a given row are rotationally offset from the previous row by one-third of the radial angle RA. The result is a three row repeating pattern of perforations 108*a*. A preferred pattern of rotation for succeeding rows is shown in cross section as follows: 102*e* (FIG. 4), 102*a*1 (FIG. 5), and 102*a*2 (FIG. 6). One skilled in the art will recognize that the alignment of combining tube perforations 108*a* may vary to produce different process results. The lateral offset may vary from about −15° to about +15° in relation to longitudinal axis X—X. The upstream to downstream angle of said perforations 108*a* may vary from about −60° to about +60° in relation to longitudinal axis X—X. In said preferred embodiment, the longitudinal axes (AJ, AB, FIG. 2) of perforations 108*a* are substantially in linear alignment with longitudinal axis X—X (i.e. a lateral offset of approximately 0°), and are at an upstream to downstream angle relative to the longitudinal axis X—X of about 45°, resulting in concurrent injection of second fluid 220 into first fluid 120. The foregoing perforation layout results in uniform dispersion of second fluid 220 into first fluid 120 with minimal recombination and minimal solid deposition along the internal wall of the combining tube 108 in fouling applications. One skilled in the art will recognize that other embodiments of the invention may feature combining tube perforations 108*a* having other arrangements to produce different process results.

In a preferred embodiment, chamber assembly 200 comprises first and second chamber closure flanges 202, 204 attached to the ends of chamber body 208. Second fluid inlet subassembly 206 joins chamber body 208 along its periphery at the midpoint between said first and second chamber closure flanges 202, 204 in such a manner as to induce a tangential flow of second fluid 220 into the annular space 502 formed between chamber body 208 and combining tube 108 in contact apparatus 10.

Referring to FIG. 2, in a preferred embodiment, first and second chamber closure flanges 202, 204 are standard raised face weld neck flanges which bolt to stinger end closure flange 106 and outlet end closure flange 302 using closure bolts 400 and closure nuts 402, effectively sealing chamber assembly 200 around combining tube 108. Orientation of chamber assembly 200 may be altered to produce either clockwise or counterclockwise tangential flow patterns (demonstrated by arrows 220 in FIG. 3) in annular space 502 by choosing which chamber closure flange 202 or 204 is bolted to stinger assembly 100 at stinger end closure flange 106.

Chamber body 208 is made of tubular material having a circular cross section, preferably seamless pipe having a nominal size such that the outer surface of combining tube 108 is not directly impinged by second fluid 220 as it enters annular space 502. In a preferred embodiment (FIGS. 1 through 3), the use of an external configuration for tangential diverter 206*c* allows minimal diameter material to be used for chamber body 208. In said preferred embodiment, chamber body 208 is constructed of seamless pipe having an internal diameter such that radial distance AF between the inside wall of chamber body 208 and the outer wall of combining tube 108 is from about 40% to about 75% of the inside diameter of second fluid inlet subassembly 206. In other embodiments of contact apparatus 10 which feature different configurations for tangential diverter 206*c* or omit tangential diverter 206*c* completely, a radial distance AF of up to about 150% of the inside diameter of second fluid inlet subassembly 206 may be required to prevent direct impingement. The diameter of chamber body 208 required to prevent direct impingement, as well as the appropriate wall thickness for chamber body 208 may readily be determined by one skilled in the art using well established engineering principles applied to the process data at hand. Avoiding direct impingement of second fluid 220 on combining tube allows full rotational flow path development for second fluid 220 within annular space 502, providing even distribution of second fluid 220 along the full length of combining tube 108 and minimizing damage to combining tube 108 by any entrained liquid or solid particles that may be present in second fluid 220.

In a preferred embodiment, second fluid inlet subassembly 206 (FIG. 1) consists of second inlet connection 206*a*, second inlet line 206*b*, and tangential diverter 206*c*. Nominal sizing of all components in second fluid inlet subassembly 206 may readily be determined by one skilled in the art based on application of established engineering principles to the process operating data at hand.

Second inlet connection 206*a* is the conduit by which second fluid 220 enters contact apparatus 10 from the process inlet piping. Second inlet connection 206*a* is a standard piping connection chosen to facilitate installation of the assembled contact apparatus 10 into the process piping arrangement. In a preferred embodiment, second inlet stub end 206*aa*, second inlet lap joint flange 206*ab*, and second inlet flange retainers 206*ac* comprise second inlet connection 206*a*. In the illustrated embodiment, second inlet flange retainers 206*ac* are small weld beads on the outer stub end surface restricting lateral movement of second inlet lap joint flange 206*ab* along second fluid inlet subassembly 206. A rotationally oriented connection such as a raised face weld neck flange or another non-rotationally oriented connection such as a sanitary fitting may be used for second inlet connection 206*a* in other embodiments of the invention. Non-rotationally oriented connections, such as the lap joint-stub end combination of the illustrated preferred embodiment reduce fabrication, assembly, installation, and maintenance manhour requirements.

Second inlet line 206*b* connects tangential diverter 206*c* to second inlet connection 206*a* at second inlet stub end 206*aa*. Second inlet line 206*b* serves as a spacer to move second inlet connection 206*a* away from chamber body 208 far enough to accommodate insulation of chamber body 208 while maintaining ease of connection and disconnection of the process piping. In a preferred embodiment shown in FIG. 3, second inlet line 206*b* is a straight piece of seamless pipe having a longitudinal axis AG. One skilled in the art will recognize that other embodiments of the invention may utilize fittings such as a concentric pipe reducer in place of straight seamless pipe for inlet subassembly 206, or may omit the component entirely.

Tangential diverter 206*c* provides a means of establishing a tangential entry for second fluid 220 into annular space 502 such that a tangential flow pattern with respect to chamber body 208 is established for second fluid 220 within the annular space 502. In a preferred embodiment as shown in FIG. 3, tangential diverter 206*c* comprises a 90° bend comprising a suitable curvature relative to AG, attached to second inlet line 206*b* at the_upstream end and machined to conform to the inside diameter of chamber body 208 beginning at a tangent point 206*cb* on the inside wall of the outer periphery of said 900 bend at injection port 206*ca*. Tangential diverter 206*c* is mated to a corresponding opening in chamber body 208 in a manner such that second fluid inlet subassembly 206 is perpendicular to the longitudinal axis of chamber body 208 in the completed chamber assembly 200, and tangent point 206*cb* is tangent to the inner periphery of chamber body 208 at the point of attachment to said chamber body 208. In the illustrated preferred embodiment, tangential diverter 206*c* is attached to chamber body 208 by complete fusion weld with full penetration, and in a manner which results in no intrusion of second inlet subassembly 206 past the inner periphery 208*c* of chamber body 208. Wall thickness of the tangential diverter 206*c* is selected so that it is at least as thick as the material used to fabricate chamber body 208.

Tangential entries are commonly used in cyclone and centrifugal separator design. Persons of ordinary skill in the art will understand how to fashion a suitable tangential diverter for a given apparatus. See *PERRY'S CHEMICAL ENGINEERING HANDBOOK*, pp. 14-83–14-84; 17-27–17-39; and 26-31–26-36 (Int'l Version, $7^7$ ed. 1997), incorporated herein by reference. One skilled in the art will recognize that tangential diverter 206*c* may comprise arrangements other than a machined 90° bend or may be omitted completely in other embodiments of contact apparatus 10 as long as tangential entry of second fluid 220 into annular space 502 is accomplished with no direct impingement on combining tube 108.

Referring to FIGS. 1 and 2, outlet assembly 300 comprises outlet connection 306, outlet transition 304, and outlet end closure flange 302. In a preferred embodiment, outlet end closure flange 302 is a raised face blind flange designed to mate with either first chamber closure flange 202 or second chamber closure flange 204. Outlet end closure flange 302 is through bored along longitudinal axis X—X to form mating hole 308, which comprises bore bevel 308*a* as previously described. In assembled contact apparatus 10, stinger discharge end 108*b* slides through mating hole 308, forming a running slip fit between the two surfaces and effectively sealing chamber assembly 200 in conjunction with stinger end closure flange 106.

Outlet transition 304 connects outlet end closure flange 302 and outlet connection 306 in a manner which maintains longitudinal axis X—X between all components of outlet section 300. Outlet transition 304 forms the transition between the external diameter A–H of the combining tube 108 and the internal diameter A–I of the outlet connection 306. In a preferred embodiment, the internal diameter AJ of outlet transition 304 at 308*b* is 0 mm to 5 mm larger than the external diameter A–H of stinger discharge end 108*b*. The internal diameter A–Z at the point of connection 306*d* to outlet connection 306 is nominally the same as that of the process piping to which outlet connection 306 is to be connected. FIG. 1 and FIG. 2 illustrate outlet transition 304 as a standard concentric pipe reducer. One skilled in the art will recognize that in other embodiments of the present invention outlet transition 304 may comprise other types of configurations such as a straight pipe section, venturi, orifice arrangement, etc., or may be omitted completely based on process application and individual piping arrangements.

Outlet connection 306 is the point by which mixed fluid 320, comprising first fluid 120 and second fluid 220, exits contact apparatus 10. Outlet connection 306 is a standard piping connection chosen to facilitate installation of the present invention into the process piping arrangement. In a preferred embodiment, outlet stub end 306*a*, outlet lap joint flange 306*b*, and outlet flange retainers 306*c* comprise outlet connection 306. Outlet flange retainers 306*c* are small weld beads on the outer stub end surface to restrict lateral movement of outlet lap joint flange 306*b* along outlet assembly 300. A rotationally oriented connection such as a raised face weld neck flange or another non-rotationally oriented connection such as a sanitary fitting may be used for outlet connection 306 in other embodiments of the invention. Non-rotationally oriented connections, such as the lap joint-stub end combination of the illustrated preferred embodiment reduce fabrication, assembly, installation, and maintenance manhour requirements.

The materials and mechanical design specification of closure bolts 400, closure nuts 402, and chamber gaskets 500 will vary with each individual application. In a preferred embodiment, an appropriate size and number of lubricant coated bolts, preferably PTFE coated Grade 8 machine bolts and PTFE coated heavy hex nuts are used for closure bolts 400 and closure nuts 402 allowing accurate, uniform tightening and ease of assembly and disassembly of these fastener sets. In a preferred embodiment, chamber gasket 500 is a standard 1/16" thick ring gasket designed for use with raised face flanges. Filled PTFE-based gasketing materials containing no asbestos such as the various grades of GYLON® gasketing marketed by Garlock Sealing Technologies are generally suitable for chamber gaskets 500 in most applications due to their chemical resistance and good sealing capability.

Materials of construction and dimensions for all components of contact apparatus 10 will vary based on the process operating conditions. In all cases where permanent connections are made in the fabrication of any components of the present invention, these connections preferably are made using machining, setup, and welding techniques which result in complete fusion welds with full joint penetration while maintaining component alignment. In a preferred embodiment, all components are subjected to stress relief procedures after welding to eliminate all differential stresses induced during the welding processes and restore original corrosion resistance properties of the materials used to construct said components. Proper procedures for machining, welding, and stress relief can readily be determined by one skilled in the art based on established principles of engineering and materials science.

In practice, the contact apparatus 10 of the present invention is installed in a vertical orientation, wherein the flow of first fluid 120 proceeds from top to bottom. Once assembled, the contact apparatus 10 is installed in a given process by attaching first inlet connection 102 to the process fluid inlet piping to allow entry of first fluid 120. Second inlet connection 206*a* is then attached to the process inlet piping to allow entry of second fluid 220. Finally, outlet connection 306 is attached to the process outlet piping to allow egress of mixed fluid 320 from contact apparatus 10.

At commencement of operation, fluid streams are established within the contact apparatus 10 wherein first fluid 120 enters contact apparatus 10 through first inlet connection 102 flowing through inlet transition 104 into combining tube 108. These components form a fluid conduit within contact apparatus 10. Second fluid 220 enters the contact apparatus 10 through second fluid inlet subassembly 206, flowing tangentially into the annular space 502 between chamber body 208 and the outside of combining tube 108. Second fluid 220 flows from annular space 502 through combining tube perforations 108*a* and mixes with first fluid 120 as it flows through combining tube 108. The intimate mixing of first fluid 120 and second fluid 220 within combining tube 108 facilitates heat and mass transfer between the fluids. The mixed fluid 320 flows from combining tube 108 at stinger discharge end 108*b*, through outlet assembly 300 and exits contact apparatus 10 into the process piping via the outlet connection 306.

In a preferred embodiment best illustrated in FIG. 2, first fluid 120 is a liquid and second fluid 220 is a condensable vapor at saturated conditions and at a higher temperature than first fluid 120. In this embodiment, liquid moves as a stream from the liquid inlet process piping through the conduit formed by first inlet stub end 102*a*, inlet transition 104, combining tube 108, outlet transition 304, and outlet stub end 306*a*. Vapor flows from the vapor inlet process piping through the conduit formed by second inlet stub end 206*aa*, second inlet line 206*b*, and tangential diverter 206*c* into annular space 502. The vapor mixes with the liquid stream as the vapor passes through combining tube perforations 108*a* into combining tube 108, wherein the vapor condenses, giving up its latent heat and part of its sensible heat to the liquid which is warmed in the exchange. The condensed vapor/liquid mixture 320 flows from combining tube 108 into outlet transition 304, finally exiting contact apparatus 10 by flowing from outlet stub end 306*a* into the liquid outlet process piping.

In said preferred embodiment, as vapor passes through tangential diverter 206*c*, a gradual change in flow direction is imposed on the vapor stream. Momentum forces act on the vapor and any solid or liquid material entrained therein, forcing the bulk of the material toward the outer periphery of said diverter 206*c* and creating a stratified velocity profile with a region of higher velocity and pressure toward the outer periphery of diverter 206*c* and a region of lower velocity and pressure toward the inner periphery of diverter 206*c*.

The stratified vapor stream passes through injection port 206*ca* into annular space 502 defined by chamber body 208 on the outer periphery and combining tube 108 on the inner periphery, and confined at the ends by stinger closure flange 106 and outlet closure flange 302. The initial high speed tangential flow path of second fluid 220 at the entry point 208*b* induces a bulk rotational motion of the vapor within annular space 502 around the inner periphery 208*c* of chamber body 208. Centrifugal forces resulting from the rotational motion act on the vapor causing entrained solids and liquids to separate from the vapor stream and flow along the inside wall 208*a* of chamber body 208 toward outlet closure flange 302, where they accumulate. These solids and liquids are eventually swept from annular space 502 through combining tube perforations 108*a* or to a lesser extent through slip fit clearance 524 into the mixed fluid 320 by flowing vapor.

The placement of unperforated section 114 on combining tube 108 minimizes short-circuiting of vapor flow directly from tangential diverter discharge 206*a* through combining tube perforations 108*a*, thus helping to establish the longer rotational flow path for vapor within annular space 502. As vapor flows around the periphery of annular space 502, its velocity is dissipated by frictional forces allowing the vapor to expand evenly along the length of annular space 502 while maintaining a stratified velocity profile. As illustrated in FIG. 3, the vapor flow spirals inward toward the combining tube 108 as the velocity continues to dissipate, resulting in a well-distributed pressure profile along the combining tube 108 at the entrance to combining tube perforations 108*a*.

Vapor flows through combining tube perforations 108*a* into combining tube 108 where it mixes with the liquid flowing therein. A shearing action is induced as the high speed vapor jets impinge on the liquid at the exit of combining tube perforations 108*a* producing vapor bubbles and inducing vigorous liquid motion as it gives up its kinetic energy to the liquid. The greater the kinetic energy of the vapor stream as it enters the liquid, the smaller the bubble produced and the more aggressive the liquid motion induced. Heat and mass transfer rates are highly dependent upon relative velocities and interfacial areas between the materials involved. Insufficient induction velocity of the vapor into the liquid in combining tube 108 results in reduced heat and mass transfer rates as well as high vibration and noise levels due to shock waves formed when large vapor bubbles collapse upon condensation.

In the extant embodiment of contact apparatus 10, high vapor induction velocities are used to produce very small bubbles and aggressive liquid motion, resulting in extraordinarily high heat and mass transfer rates inside combining tube 108. In practice, combining tube perforations 108*a* are varied in number and size to produce a perforation exit vapor velocity to bulk liquid velocity ratio preferably over 100:1 and frictional pressure losses resulting from vapor flow through said perforations 108*a* greater than 0.3 atm, and preferably greater than 1.0 atm throughout the normal operating range of the contact apparatus 10 while maintaining bore diameter 108*g* of the perforations 108*a* preferably between 5 mm and 10 mm. The calculations required to establish the number and size of combining tube perforations 108*a* required to achieve this process objective can readily be made by one skilled in the art based on application of well established engineering principles to the process data at hand.

In this preferred embodiment, combining tube perforations 108*a* are grouped into upstream section 110 and downstream section 112 separated by unperforated section 114. Perforations 108*a* are drilled at a downstream slant of 30° to 60°, preferably 45° in relation to the longitudinal axis X—X of the combining tube 108 and are in axial alignment with said longitudinal axis X—X. This results in an unencumbered roughly hyperbolic initial vapor flow path concurrent with the liquid flow. This initial flow path presents minimal opportunity for bubble recombination and the attendant vibration and noise experienced as these congregated bubbles collapse. Combining tube perforations 108*a* in this embodiment of the invention are arranged in radial rows having symmetrical radial distribution with a minimum radial angle of 45° between perforations 108*a* (FIG. 4). Rows of perforations 108*a* are arranged in a rotationally offset three row pattern as shown in FIGS. 4, 5, and 6. This layout pattern and perforation orientation provides a multiplicity of high speed nonintersecting jets of vapor that thoroughly chum the flowing liquid within the combining tube 108, inducing highly turbulent eddy flow patterns within the liquid phase. This aggressive fluid motion results in even distribution and rapid condensation of the vapor and promotes maximum turbulence and mixing of the fluids within combining tube 108. The overall result is quiet operation and extraordinarily high heat and mass transfer rates over the operating design range for the contacting apparatus 10. In condensing, the vapor bubbles give up their latent heat and a portion of their specific heat to the liquid. The warmed liquid flows out of the combining tube 108 into the outlet transition 304 as it passes from the chamber assembly 200.

A small quantity of vapor also flows through the slip fit clearance 504 between the stinger discharge end 108*b* and the outlet end closure flange 302, joining the main liquid flow as it exits contact apparatus 10 by flowing from the outlet transition 304 through the outlet stub end 306*a* and into the liquid outlet process piping. This small flow helps minimize solids accumulation in the slip fit clearance 504, thereby promoting easy disassembly of the unit for maintenance at the proper time.

In operation, shock waves result from the collapse of vapor bubbles as they condense within the combining tube 108. The slip fit clearance 504 at the outlet end closure flange 302 allows a slight amount of lateral motion of the combining tube 108, thus allowing the absorption and dissipation of energy contained in the shock waves in the form of very restricted motion of the combining tube 108 itself. The absorption and dissipation of this energy through induced motion of the combining tube 108 promotes quiet operation of the unit throughout its designed operational range. Absorbed energy and stresses from the induced vibration of combining tube 108 are either dissipated as heat or transferred to the stinger end closure flange 106 at the base joint with the combining tube 108. The heavy duty construction techniques and stress relief used in the fabrication of this joint in the preferred embodiment allow vibrational stresses to be absorbed with no deterioration in the quality of the joint over extended and severe service conditions.

Persons of ordinary skill in the art will recognize that many modifications may be made to the present invention without departing from the spirit and scope of the present invention. The embodiment described herein is meant to be illustrative only and should not be taken as limiting the invention, which is defined in the following claims.

I claim:

1. An apparatus for directly contacting a first fluid with a second fluid, said apparatus comprising;

a sealed chamber assembly comprising a chamber wall defining a chamber bore having a chamber bore diameter and a chamber longitudinal axis, said chamber wall comprising an injection port extending through said chamber wall perpendicular to the longitudinal axis of the chamber bore and tangential to an inner periphery of said chamber assembly, said injection port being in fluid communication with said second fluid;

a combining tube comprising a combining tube wall defining a combining tube bore having a combining tube bore diameter that is less than said chamber bore diameter and having a combining tube longitudinal axis which is substantially the same as said chamber longitudinal axis, said combining tube bore comprising an upstream port and a downstream port in fluid communication with said first fluid, said chamber wall and said combining tube wall defining an annular space therebetween, said chamber wall being at radial distance from said combining tube wall which is greater than 40% of said injection port diameter;

said combining tube wall comprising an upstream set of perforations adjacent to said upstream port, a downstream set of perforations adjacent to said downstream port, and an unperforated section between said upstream set of perforations and said downstream set of perforations, said unperforated section being adjacent to said injection port and extending beyond said injection port in both the upstream and downstream directions along said combining tube wall, wherein said upstream set of perforations and said downstream set of perforations have perforation longitudinal axes at an upstream to downstream angle to said chamber longitudinal axis of from about −60 to about 60° and have a lateral offset to said chamber longitudinal axis of from about −15° to about 15°.

2. The apparatus of claim 1 wherein said upstream to downstream angle is about 45°.

3. The apparatus of claim 1 wherein said lateral offset is about 0°.

4. The apparatus of claim 1 wherein said perforations have an internal diameter of from about 5 to about 10 millimeters.

5. The apparatus of claim 2 wherein said perforations have an internal diameter of from about 5 to about 10 millimeters.

6. The apparatus of claim 1 wherein said upstream set of perforations and said downstream set of perforations comprise rows, said rows comprising a number of perforations at a rotational angle to adjacent rows adapted to produce a repeating perforation pattern at intervals of every three to six rows.

7. The apparatus of claim 6 wherein said rows have the same number of perforations per row.

8. The apparatus of claim 2 wherein said upstream set of perforations and said downstream set of perforations comprise rows, said rows comprising a number of perforations at a rotational angle to adjacent rows adapted to produce a repeating perforation pattern at intervals of every three to six rows.

9. The apparatus of claim 8 wherein said rows have the same number of perforations per row.

10. The apparatus of claim 4 wherein said upstream set of perforations and said downstream set of perforations comprises rows, said rows comprising a number of perforations at a rotational angle to adjacent rows adapted to produce a repeating perforation pattern at intervals of every three to six rows.

11. The apparatus of claim 4 wherein said rows have the same number of perforations per row.

12. The apparatus of claim 1 wherein said upstream set of perforations and said downstream set of perforations comprise an average diameter and said perforation longitudinal axes of adjacent circumferential rows are at a distance from one another of three times said average diameter or more.

13. The apparatus of claim 2 wherein said upstream set of perforations and said downstream set of perforations comprise an average diameter and said perforation longitudinal axes of adjacent circumferential rows are at a distance from one another of three times said average diameter or more.

14. The apparatus of claim 4 wherein said upstream set of perforations and said downstream set of perforations comprise an average diameter and said perforation longitudinal axes of adjacent circumferential rows are at a distance from one another of three times said average diameter or more.

15. The apparatus of claim 5 wherein said upstream set of perforations and said downstream set of perforations comprise an average diameter and said perforation longitudinal axes of adjacent circumferential rows are at a distance from one another of three times said average diameter or more.

16. The apparatus of claim 6 wherein said upstream set of perforations and said downstream set of perforations comprise an average diameter and said perforation longitudinal axes of adjacent circumferential rows are at a distance from one another of three times said average diameter or more.

17. The apparatus of claim 7 wherein said upstream set of perforations and said downstream set of perforations comprise an average diameter and said perforation longitudinal axes of adjacent circumferential rows are at a distance from one another of three times said average diameter or more.

18. The apparatus of claim 8 wherein said upstream set of perforations and said downstream set of perforations comprise an average diameter and said perforation longitudinal axes of adjacent circumferential rows are at a distance from one another of three times said average diameter or more.

19. The apparatus of claim 11 wherein said upstream set of perforations and said downstream set of perforations comprise an average diameter and said perforation longitudinal axes of adjacent circumferential rows are at a distance from one another of three times said average diameter or more.

20. The apparatus of claim 1 wherein said injection port and said combining tube are adapted to substantially evenly distribute pressure along said chamber longitudinal axis.

21. An apparatus for directly contacting a first fluid with a second fluid, said apparatus comprising;

a sealed chamber assembly comprising a chamber wall defining a chamber bore having a chamber bore diameter and a chamber longitudinal axis, said chamber wall comprising an injection port extending through said chamber wall perpendicular to the longitudinal axis of the chamber bore and tangential to an inner periphery of said chamber assembly, said injection port being in fluid communication with said second fluid;

a combining tube comprising a combining tube wall defining a combining tube bore having a combining tube bore diameter that is less than said chamber bore diameter and having a combining tube longitudinal axis which is substantially the same as said chamber longitudinal axis, said combining tube bore comprising an upstream port and a downstream port in fluid communication with said first fluid, said chamber wall and said combining tube wall defining an annular space therebetween, said chamber wall being at radial distance from said combining tube wall which is greater than 40% of said injection port diameter;

said combining tube wall comprising an upstream set of perforations adjacent to said upstream port, a downstream set of perforations adjacent to said downstream port, and an unperforated section between said first set of perforations and said second set of perforations, said unperforated section being adjacent to said injection port, and extending beyond said injection port in both the upstream and downstream directions along said combining tube wall; said injection port being adapted to produce a tangential flow pattern which does not directly impinge said combining tube wall; said sealed chamber assembly and said perforations being adapted to produce a turbulent flow of said first fluid and said second fluid within said combining tube bore upon injection of said second fluid through said injection port.

22. The apparatus of claim 21 wherein said chamber wall is at a radial distance from said combining tube wall which is greater than 40% of said injection port diameter.

23. The apparatus of claim 21 wherein unperforated section has a length along said chamber longitudinal axis that extends from about 1 cm to about 2 cm upstream of said injection port diameter and extends from about 1 cm to about 2 cm downstream of said injection port diameter.

24. The apparatus of claim 22 wherein unperforated section has a length along said chamber longitudinal axis that extends from about 1 cm to about 2 cm upstream of said injection port diameter and extends from about 1 cm to about 2 cm downstream of said injection port diameter.

25. An apparatus for directly contacting a first fluid with a second fluid, said apparatus comprising;

a sealed chamber assembly comprising a chamber wall defining a chamber bore having a chamber bore diameter and a chamber longitudinal axis, said chamber wall comprising an injection port, said injection port being in fluid communication with said second fluid;

a combining tube comprising a combining tube wall defining a combining tube bore having a combining tube bore diameter that is less than said chamber bore diameter and having a combining tube longitudinal axis which is substantially the same as said chamber longitudinal axis, said combining tube bore comprising an upstream port and a downstream port in fluid communication with said first fluid, said chamber wall and said combining tube wall defining an annular space therebetween, said combining tube comprising a tip bevel comprising a protrusion adapted to mate with a bore bevel of an outlet assembly in a sliding fit;

said combining tube wall comprising an upstream set of perforations adjacent to said upstream port, a downstream set of perforations adjacent to said downstream port, and an unperforated section between said upstream set of perforations and said downstream set of perforations, said unperforated section being adjacent to said injection port; said injection port being adapted to prevent said second fluid from directly impinging said combining tube wall; said sealed chamber assembly and said perforations being adapted to produce a turbulent flow of said first fluid and said second fluid within said combining tube bore upon injection of said second fluid through said injection port.

26. The apparatus of claim 25 wherein said tip bevel comprises an angle from upstream to downstream of about 10° to about 30° relative to said chamber longitudinal axis.

27. The apparatus of claim 25 wherein said bore bevel comprises an angle from upstream to downstream of about 30° to about 45° relative to said chamber longitudinal axis.

28. The apparatus of claim 25 wherein said mating between said tip bevel and said bore bevel is adapted to produce a self-centering sealed chamber assembly of said apparatus.

29. The apparatus of claim 26 wherein said mating between said tip bevel and said bore bevel is adapted to produce a self-centering sealed chamber assembly of said apparatus.

30. The apparatus of claim 22 wherein said mating between said tip bevel and said bore bevel is adapted to produce a self-centering sealed chamber assembly of said apparatus.

31. The apparatus of claim 25 wherein said protrusion is adapted to facilitate disassembly of said apparatus.

32. The apparatus of claim 26 wherein said protrusion further is adapted to facilitate disassembly of said apparatus.

33. The apparatus of claim 27 wherein said protrusion further is adapted to facilitate disassembly of said apparatus.

34. The apparatus of claim 28 wherein said protrusion further is adapted to facilitate disassembly of said apparatus.

35. The apparatus of claim 29 wherein said protrusion further is adapted to facilitate disassembly of said apparatus.

36. An apparatus for directly contacting a first fluid with a second fluid, said apparatus comprising;

a sealed chamber assembly comprising a chamber wall defining a chamber bore having a chamber bore diameter and a chamber longitudinal axis, said chamber wall comprising an injection port extending through said chamber wall perpendicular to the longitudinal axis of the chamber bore and tangential to an inner periphery of said chamber assembly, said injection port being in fluid communication with said second fluid;

a combining tube comprising a combining tube wall defining a combining tube bore having a combining tube bore diameter that is less than said chamber bore diameter and having a combining tube longitudinal axis which is substantially the same as said chamber longitudinal axis, said combining tube bore comprising an upstream port and a downstream port in fluid communication with said first fluid, said chamber wall and said combining tube wall defining an annular space therebetween, said chamber wall being at radial distance from said combining tube wall which is greater than 40% of said injection port diameter;

said combining tube wall comprising an upstream set of perforations adjacent to said upstream port, a downstream set of perforations adjacent to said downstream port, and an unperforated section between said upstream set of perforations and said downstream set of perforations, said unperforated section being adjacent to said injection port and extending beyond said injection port in both the upstream and downstream directions along said combining tube wall, said sealed chamber assembly and said perforations being adapted to produce a turbulent flow of said first fluid and said second fluid within said combining tube bore upon injection of said second fluid through said injection port; said upstream set of perforations being adapted to facilitate flow of said second fluid into said combining tube bore from the most upstream end of said annular space and said downstream set of perforations being adapted to facilitate flow of said second fluid into said combining tube bore from the most downstream end of said annular space.

37. An apparatus for directly contacting a first fluid with a second fluid, said apparatus comprising;

a sealed chamber assembly comprising a stinger assembly, a chamber assembly, and an outlet assembly, each comprising an upstream end and a downstream end;

said stinger assembly comprising a combining tube comprising a combining tube wall defining a combining tube bore having a longitudinal axis extending lengthwise through said sealed chamber assembly from an upstream port to a downstream port, said combining tube extending from an upstream junction with an inlet transition through a stinger end closure flange to a mating hole in said outlet assembly; said combining tube comprising a tip bevel comprising a protrusion at an angle from upstream to downstream of about 10° to about 30° relative to said combining tube bore longitudinal axis extending about 5 mm to about 10 mm beyond said mating hole; said combining tube wall comprising an upstream set of perforations adjacent to said upstream port, a downstream set of perforations adjacent to said downstream port, and an unperforated section between said upstream set of perforations and said downstream set of perforations, said perforations having an internal diameter of about 5 to about 10 millimeters wherein said perforations comprise adjacent circumferential rows having the same number of perforations per row, wherein perforations for a given row are at a relative circumferential rotation of about 15° relative to perforations in adjacent rows, resulting in a three row repeating pattern; wherein said upstream to downstream angle of said perforations is about 45°;

said chamber assembly comprising a chamber body comprising an inner wall and comprising an upstream chamber closure flange and a downstream chamber closure flange; a chamber wall defining a chamber bore comprising a longitudinal axis through said chamber body; said chamber assembly comprising an annular space between said inner wall of said chamber assembly and said combining tube wall; said chamber assembly comprising a fluid inlet subassembly comprising an inlet connection, an inlet line and a tangential diverter in sealed fluid communication with said annular space adjacent to said unperforated section of said combining tube;

said outlet assembly comprising an inner wall and comprising an outlet end closure flange and an outlet connection; said outlet end closure flange further comprising said mating hole and a sealing face; said mating hole comprising a bore bevel from about 5 to about 10 millimeters downstream of said sealing face, said bore bevel proceeding toward said sealing face at an angle of about 30° to about 45° relative to said chamber longitudinal axis.

38. The apparatus of claim 37 wherein said outlet assembly comprises an outlet transition adapted to form a transition between the external diameter of said combining tube and the internal diameter of said outlet connection.

39. An apparatus for directly contacting a first fluid with a second fluid, said apparatus comprising;

a sealed chamber assembly comprising a chamber wall defining a chamber bore having a chamber bore diameter and a chamber longitudinal axis, said chamber wall comprising an injection port extending through said chamber wall perpendicular to the longitudinal axis of the chamber bore and tangential to an inner periphery of said chamber assembly, said injection port being in fluid communication with said second fluid;

a combining tube comprising a combining tube wall defining a combining tube bore having a combining tube bore diameter that is less than said chamber bore diameter and having a combining tube longitudinal axis which is substantially the same as said chamber longitudinal axis, said combining tube bore comprising an upstream port and a downstream port in fluid communication with said first fluid, said chamber wall and said combining tube wall defining an annular space therebetween, said chamber wall being at radial distance from said combining tube wall which is greater than 40% of said injection port diameter;

said apparatus comprising means for preventing said second fluid from directly impinging said combining tube wall.

40. An apparatus for directly contacting a first fluid with a second fluid, said apparatus comprising:

a sealed chamber assembly comprising a chamber wall defining a chamber bore having a chamber bore diameter and a chamber bore longitudinal axis, said chamber wall comprising an injection port extending through said chamber wall perpendicular to the longitudinal axis of the chamber bore and tangential to an inner periphery of said chamber assembly, said injection port being in fluid communication with said second fluid, and;

a combining tube comprising a combining tube wall defining a combining tube bore having a combining tube bore diameter that is less than said chamber bore diameter and having a combining tube longitudinal axis which is substantially the same as said chamber longitudinal axis, said combining tube bore comprising an upstream port and a downstream port in fluid communication with said first fluid, said chamber wall and said combining tube wall defining an annular space therebetween, said chamber wall being at radial distance from said combining tube wall which is greater than 40% of said injection port diameter, said combining tube wall comprising an upstream set of perforations adjacent to said upstream port, a downstream set of perforations adjacent to said downstream port, and an unperforated section between said upstream set of perforations and said downstream set of perforations, said unperforated section being adjacent to said injection port and extending beyond said injection port in both the upstream and downstream directions along said combining tube wall; said sealed chamber assembly and said perforations being adapted to produce a turbulent flow of said first fluid and said second fluid within said combining tube bore upon injection of said second fluid through said injection port, said turbulent flow being consistent with non-fouling operation of said apparatus.

41. The apparatus of claim 1 wherein said turbulent flow is concurrent.

42. An apparatus for directly contacting a first fluid with a second fluid, said apparatus comprising:

a sealed chamber assembly comprising a chamber wall having a chamber wall inner periphery defining a chamber bore having a chamber bore diameter and a chamber bore longitudinal axis, said chamber wall comprising an injection port, said injection port being in fluid communication with said second fluid, said injection port having an injection port inside diameter defining an injection port inner periphery, said injection port being located laterally along said chamber wall essentially equidistant from either end of said sealed chamber assembly, said injection port inner periphery being tangent to said chamber wall along said chamber wall inner periphery and oriented with regard to said chamber wall in such a manner as to introduce said second fluid into said chamber bore at an angle essentially perpendicular to said chamber bore longitudinal axis and tangential to said chamber wall inner periphery;

a combining tube comprising a combining tube wall having a combining tube outer periphery and a combining tube inner periphery said combining tube inner periphery defining a combining tube bore, said combining tube bore having a combining tube longitudinal axis which is substantially the same as said chamber bore longitudinal axis, said combining tube bore comprising an upstream port and a downstream port in fluid communication with said first fluid, said combining tube outer periphery defining a combining tube outside diameter which is less than said chamber bore diameter, said chamber wall inner periphery and said combining tube outer periphery defining an annular space therebetween, said combining tube ouside diameter being such that the distance between the said combining tube outer periphery and the said chamber wall inner periphery is greater than 40% of said injection port inside diameter;

said combining tube wall comprising an upstream set of perforations adjacent to said upstream port, a downstream set of perforations adjacent to said downstream port, and an unperforated section between said upstream set of perforations and said downstream set of perforations, said unperforated section being adjacent to said injection port and extending beyond said injection port in both the upstream and downstream directions along said combining tube wall; said sealed chamber assembly and said perforations being adapted to produce a turbulent flow of said first fluid and said second fluid within said combining tube bore upon injection of said second fluid through said injection port, said turbulent flow being consistent with non-fouling operation of said apparatus.

* * * * *

UNITED STATES PATENT AND TRADEMARK OFFICE

CERTIFICATE OF CORRECTION

PATENT NO. : 6,767,007 B2
DATED : July 27, 2004
INVENTOR(S) : Homer C. Luman

It is certified that error appears in the above-identified patent and that said Letters Patent is hereby corrected as shown below:

Column 17,
Line 33, that portion of the claim depending from claim "1" should read as depending from claim -- 40 --.

Signed and Sealed this

Twelfth Day of July, 2005

JON W. DUDAS
*Director of the United States Patent and Trademark Office*